US007392003B2

(12) United States Patent
Ito

(10) Patent No.: US 7,392,003 B2
(45) Date of Patent: Jun. 24, 2008

(54) BELT UNIT AND IMAGE FORMING APPARATUS THAT INCORPORATES THE BELT UNIT

(75) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/677,289

(22) Filed: Feb. 21, 2007

(65) Prior Publication Data

US 2007/0201911 A1 Aug. 30, 2007

(30) Foreign Application Priority Data

Feb. 24, 2006 (JP) ..... 2006-048040

(51) Int. Cl.
*G03G 15/01* (2006.01)

(52) U.S. Cl. ..... 399/302; 399/303; 399/308

(58) Field of Classification Search ..... 399/284, 399/302, 303, 308, 162, 299
See application file for complete search history.

(56) References Cited

U.S. PATENT DOCUMENTS 3,947,113 A * 3/1976 Buchan et al. ..... 399/308
6,072,976 A * 6/2000 Kuriyama et al. ..... 399/302
6,716,562 B2 * 4/2004 Uehara et al. ..... 430/125.3
2002/0057934 A1 * 5/2002 Ishikawa et al. ..... 399/328
2003/0202819 A1 * 10/2003 Matsuda et al. ..... 399/121
2004/0000652 A1 * 1/2004 Guha et al. ..... 250/559.45
2004/0165915 A1 * 8/2004 Hirai et al. ..... 399/302
2006/0002746 A1 * 1/2006 Darcy et al. ..... 399/302

FOREIGN PATENT DOCUMENTS

JP 8-146781 6/1996

OTHER PUBLICATIONS

English translation of 08-146781.*
"A Comparison of Four BRDF Models", by Stephen H. Westin, Hongsong Li, and Kenneth E. Torrence; 2004.*
"Applying Appearance Standards to Light Reflection Models", by Harold B. Westlund and Gary W. Meyer; Aug. 2001.*

* cited by examiner

*Primary Examiner*—David M Gray
*Assistant Examiner*—Geoffrey T Evans
(74) *Attorney, Agent, or Firm*—Panitch Schwarze Belisario & Nadel LLP

(57) ABSTRACT

A belt unit includes an endless belt and a cleaning member. The endless belt has a value of ten-point height of roughness Rz not larger than 0.2 μm, a value of shininess not less than 100, a creep not larger than 0.03%. The cleaning member is in contact with said endless belt and removes foreign matter adhering to said endless belt. The belt unit may be applied to an image forming apparatus either of direct transfer type and intermediate transfer type.

11 Claims, 8 Drawing Sheets

FIG.5

| | | | NUMBER OF SHEETS | | | | | | | | | | | | CLEANING RESULT | TACKY BLADE |
|---|---|---|---|---|---|---|---|---|---|---|---|---|---|---|---|---|
| EXAMPLE | Rz(μm) | SHININESS | 2.5K | 5K | 7.5K | 10K | 12.5K | 15K | 17.5K | 20K | 22.5K | 25K | 27.5K | 30K | | |
| 1 | 0.06 | 134 | ○ | ○ | ○ | ○ | ○ | ○ | ○ | ○ | ○ | ○ | ○ | ○ | OK | NONE |
| 2 | 0.12 | 129 | ○ | ○ | ○ | ○ | ○ | ○ | ○ | ○ | ○ | ○ | ○ | ○ | OK | NONE |
| 3 | 0.17 | 113 | ○ | ○ | ○ | ○ | ○ | ○ | ○ | ○ | ○ | ○ | ○ | ○ | OK | NONE |
| 4 | 0.20 | 100 | ○ | ○ | ○ | ○ | ○ | ○ | ○ | ○ | ○ | ○ | ○ | ○ | OK | NONE |
| 5 | 0.24 | 106 | ○ | ○ | ○ | ○ | ○ | ○ | ○ | ○ | ○ | ○ | ○ | ○ | OK | NONE |
| 6 | 0.20 | 98 | ○ | ○ | ○ | ○ | ○ | ○ | ○ | ○ | ○ | ○ | ○ | ○ | OK | NONE |
| 7 | 0.25 | 96 | ○ | △ | ○ | ○ | △ | ○ | ○ | ○ | ○ | × | ○ | ○ | NG | NONE |
| 8 | 0.19 | 98 | ○ | ○ | ○ | ○ | ○ | △ | ○ | ○ | ○ | ○ | ○ | × | NG | NONE |
| 9 | 0.05 | 140 | ○ | ○ | ○ | ○ | ○ | ○ | ○ | ○ | ○ | ○ | ○ | ○ | OK | NONE |
| 10 | 0.05 | 141 | – | – | – | – | – | – | – | – | – | – | – | – | EVALUATION FAILED | OCCURRED |
| 11 | 0.04 | 145 | – | – | – | – | – | – | – | – | – | – | – | – | EVALUATION FAILED | OCCURRED |
| 12 | 0.04 | 140 | – | – | – | – | – | – | – | – | – | – | – | – | EVALUATION FAILED | OCCURRED |

FIG.6

| EXAMPLE | Rz(μm) | SHININESS | NUMBER OF SHEETS | | | | | | | | | | | | CLEANING RESULT | TACKY BLADE |
|---|---|---|---|---|---|---|---|---|---|---|---|---|---|---|---|---|
| | | | 2.5K | 5K | 7.5K | 10K | 12.5K | 15K | 17.5K | 20K | 22.5K | 25K | 27.5K | 30K | | |
| 1 | 0.06 | 134 | ○ | ○ | ○ | ○ | ○ | ○ | ○ | ○ | ○ | ○ | ○ | ○ | OK | NONE |
| 2 | 0.12 | 129 | ○ | ○ | ○ | ○ | ○ | ○ | ○ | ○ | ○ | ○ | ○ | ○ | OK | NONE |
| 3 | 0.17 | 113 | ○ | ○ | ○ | ○ | ○ | ○ | ○ | ○ | ○ | ○ | ○ | ○ | OK | NONE |
| 4 | 0.20 | 100 | ○ | ○ | ○ | ○ | ○ | ○ | ○ | ○ | ○ | ○ | ○ | ○ | OK | NONE |
| 5 | 0.24 | 106 | △ | ○ | ○ | × | × | ○ | ○ | ○ | × | ○ | ○ | × | NG | NONE |
| 6 | 0.20 | 98 | ○ | ○ | △ | ○ | ○ | ○ | × | ○ | ○ | ○ | × | ○ | NG | NONE |
| 7 | 0.25 | 96 | × | × | × | × | × | × | × | × | × | × | × | × | NG | NONE |
| 8 | 0.19 | 98 | ○ | △ | ○ | ○ | △ | ○ | × | ○ | ○ | × | ○ | ○ | NG | NONE |
| 9 | 0.05 | 140 | ○ | ○ | ○ | ○ | ○ | ○ | ○ | ○ | ○ | ○ | ○ | ○ | OK | NONE |
| 10 | 0.05 | 141 | – | – | – | – | – | – | – | – | – | – | – | – | EVALUATION FAILED | OCCURRED |
| 11 | 0.04 | 145 | – | – | – | – | – | – | – | – | – | – | – | – | EVALUATION FAILED | OCCURRED |
| 12 | 0.04 | 140 | – | – | – | – | – | – | – | – | – | – | – | – | EVALUATION FAILED | OCCURRED |

FIG.7

| | | | PRINTED PAGES | | | | | | | | | | | | CLEANING PERFORMANCE | TACKY BLADE |
|---|---|---|---|---|---|---|---|---|---|---|---|---|---|---|---|---|
| EXAMPLE | Rz(μm) | SHININESS | 2.5K | 5K | 7.5K | 10K | 12.5K | 15K | 17.5K | 20K | 22.5K | 25K | 27.5K | 30K | | |
| 1 | 0.06 | 134 | ○ | ○ | ○ | ○ | ○ | ○ | ○ | ○ | ○ | ○ | ○ | ○ | OK | NONE |
| 2 | 0.12 | 129 | ○ | ○ | ○ | ○ | ○ | ○ | ○ | ○ | ○ | ○ | ○ | ○ | OK | NONE |
| 3 | 0.17 | 113 | ○ | ○ | ○ | ○ | ○ | ○ | ○ | ○ | ○ | ○ | ○ | ○ | OK | NONE |
| 4 | 0.20 | 100 | ○ | ○ | ○ | ○ | ○ | ○ | ○ | ○ | ○ | ○ | ○ | ○ | OK | NONE |
| 5 | 0.24 | 106 | ○ | ○ | ○ | ○ | ○ | ○ | ○ | ○ | ○ | ○ | ○ | ○ | OK | NONE |
| 6 | 0.20 | 98 | ○ | ○ | ○ | ○ | ○ | ○ | ○ | ○ | ○ | ○ | ○ | ○ | OK | NONE |
| 7 | 0.25 | 96 | ○ | ○ | ○ | ○ | ○ | ○ | ○ | ○ | ○ | ○ | ○ | △ | NG | NONE |
| 8 | 0.19 | 98 | ○ | ○ | ○ | ○ | ○ | ○ | ○ | ○ | ○ | ○ | ○ | △ | NG | NONE |
| 9 | 0.05 | 140 | ○ | ○ | ○ | ○ | ○ | ○ | ○ | ○ | ○ | ○ | ○ | ○ | OK | NONE |
| 10 | 0.05 | 141 | – | – | – | – | – | – | – | – | – | – | – | – | EVALUATION FAILED | OCCURRED |
| 11 | 0.04 | 145 | – | – | – | – | – | – | – | – | – | – | – | – | EVALUATION FAILED | OCCURRED |
| 12 | 0.04 | 140 | – | – | – | – | – | – | – | – | – | – | – | – | EVALUATION FAILED | OCCURRED |

| | | | | | N/N | H/H | L/L | N/N | |
|---|---|---|---|---|---|---|---|---|---|
| EXAMPLE | Rz(μm) | SHININESS | CREEP(%) | INITIALLY | 20k PAGES | 40k PAGES | 60k PAGES | AFTER 60k PAGES | FINAL RESULT |
| 21 | 0.12 | 129 | 0.02 | ○ | ○ | ○ | ○ | ○ | OK |
| 22 | 0.19 | 100 | 0.03 | ○ | ○ | ○ | ○ | ○ | OK |
| 23 | 0.17 | 113 | 0.04 | ○ | ○ | △ | △ | △ | NG |
| 24 | 0.20 | 100 | 0.05 | ○ | ○ | △ | × | × | NG |
| 25 | 0.05 | 140 | 0.01 | ○ | ○ | ○ | ○ | ○ | OK |
| 26 | 0.19 | 100 | 0.01 | ○ | ○ | ○ | ○ | ○ | OK |
| 27 | 0.06 | 140 | 0.03 | ○ | ○ | ○ | ○ | ○ | OK |
| 28 | 0.20 | 100 | 0.03 | ○ | ○ | ○ | ○ | ○ | OK |

BELT UNIT AND IMAGE FORMING APPARATUS THAT INCORPORATES THE BELT UNIT

BACKGROUND OF THE INVENTION

1. Field of the Invention

The present invention relates to an image forming apparatus that incorporates a belt unit including an endless belt.

2. Description of the Related Art

An electrophotographic image forming apparatus includes a transfer belt that transports a recording medium to a transfer point defined between a photoconductive drum and a transfer roller. A toner image is transferred from the photoconductive drum onto the recording medium. Electrical discharge occurs between the photoconductive drum and a recording medium during transfer of a toner image as well as separation of the recording medium from the photoconductive drum. For solving this problem, Japanese patent application No. 8-146781 employs a belt unit that incorporates a transfer belt having a value of ten-point height of roughness Rz greater than 4 μm may cause scattering of toner particles not only onto the recording medium but also onto the belt. For removing the toner from the belt, a cleaning blade made of a resilient material such as urethane rubber is used.

Recently, demand for high quality full color images printed by electrophotographic image forming apparatus is growing, expecting as good an image quality as silver halide photography. For achieving a high resolution image, use of spherical toner having a small diameter and a toner release agent such as wax has been proposed. However, when such a toner is used with a conventional image forming apparatus incorporating an endless belt having a value of ten-point height of roughness Rz greater than 4 μm, efficient cleaning of the endless belt over a long term is rather difficult. Deterioration of the cleaning performance leads to poor image quality.

SUMMARY OF THE INVENTION

An object of the invention is to solve the aforementioned problems.

Another object of the invention is to provide a belt unit in which efficient cleaning can be performed over a long term, and an image forming apparatus that incorporates such an improved belt unit.

A belt unit includes and endless belt and a cleaning member. The endless belt has a value of ten-point height of roughness Rz in the range of 0.05 to 0.2 μm and a value of shininess in the range of 100 to 140. The cleaning member that is in contact with said endless belt and removes foreign substance adhering to said endless belt.

The endless belt has a creep not larger than 0.03%, more preferably in the range of 0.01 to 0.02%.

An image forming apparatus incorporates the aforementioned belt unit. An image forming section forms a developer image. A transfer unit transfers the developer image onto a recording medium held on the endless belt.

A direct transfer type image forming apparatus incorporates the aforementioned belt unit. An image forming section forms a developer image on a photoconductive drum. A transfer unit transfers the developer image from the photoconductive drum onto a recording medium carried on the endless belt.

An intermediate transfer type image forming apparatus incorporates the aforementioned the belt unit. An image forming section forms a developer image on the endless belt of said belt unit. A transfer unit transfers the developer image from the endless belt onto a recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 5, 6, and 7 illustrate the test results of Examples #1-#12;

DETAILED DESCRIPTION OF THE INVENTION

First Embodiment

Figure 1:
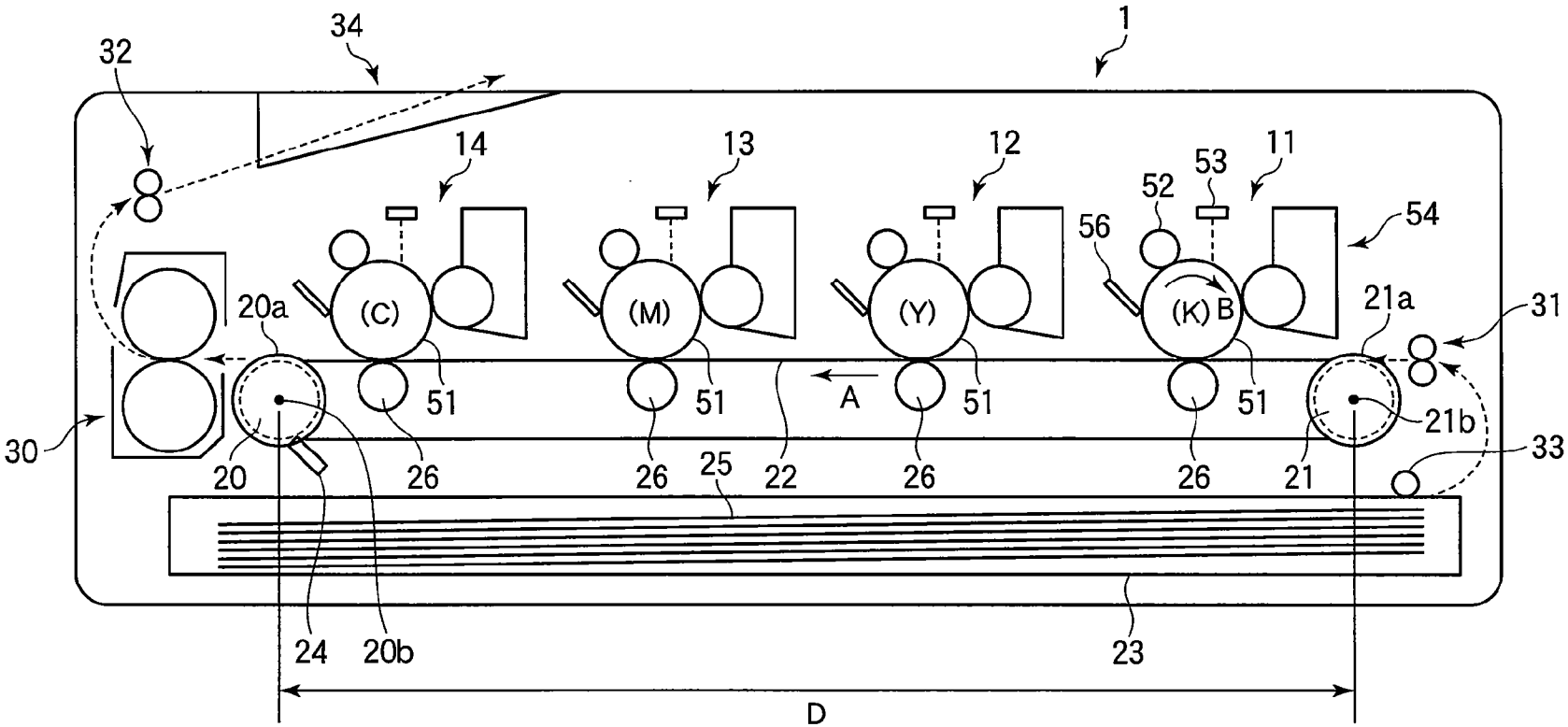
FIG. 1 illustrates a pertinent portion of an image forming apparatus of a first embodiment.

FIG. 1 illustrates a pertinent portion of an image forming apparatus 1 of a first embodiment.

Referring to FIG. 1, the image forming apparatus 1 is a tandem type color electrophotographic printer of a direct transfer system. A paper cassette 23 holds a stack of recording paper 25. A feed roller 33 feeds the recording medium 25 page by page from the paper cassette 23 into a transport path. A transport roller 31 is disposed in the transport path, and transports the pages of the recording paper 25 to image forming sections. The image forming sections 11 to 14 are aligned along the transport path, and form black (k9, yellow (Y), magenta (M), and cyan (C) images, respectively. The respective image forming sections operate in a similar fashion and differ only in color.

Each image forming section includes a photoconductive drum 51, a charging unit 52, an exposing unit 53, a developing unit 54, and a cleaning blade 56. The photoconductive drum 51 bears an electrostatic latent image on it. The charging unit 52 charges the surface of the photoconductive drum 51 uniformly. The exposing unit 53 illuminates the charged surface of the photoconductive drum 51 in accordance with image data to form an electrostatic latent image. The developing unit 54 develops the electrostatic latent image with toner into a toner image. The cleaning blade 56 is in contact with the photoconductive drum 51 to remove the toner adhering to the photoconductive drum 51 after transfer of the toner image onto the recording paper 25.

The image forming apparatus 1 includes the endless belt 22 that transports the recording paper 25, the drive roller 20 that is driven by a drive source (not shown) to drive the endless belt 22 to run in a direction shown by arrow A, the tension roller 21 that cooperates with the drive roller 20 to maintain the endless belt 22 in tension, a cleaning blade 24 that scrapes the toner off the endless belt 22, and the transfer roller 25. The transfer rollers 26 are in contact with the photoconductive drums 51 and transfer the toner images from the photoconductive drums 51 onto the recording paper 25. The drive roller 20 and the tension roller 21 have a diameter of 30 mm, and the center-to-center distance D between the drive roller 20 and the tension roller 21 is 263 mm.

A fixing unit 30 applies heat and pressure to the toner images carried on the recording paper 25 to fuse the toner images of the respective colors into a full color permanent image. The recording paper 25 is then transported by a discharge roller 32 onto a stacker 34.

Guides 20*a* and 21*a* are disposed at longitudinal ends of the drive roller 20 and tension roller 21 and guide the endless belt 22, preventing the endless belt 22 from running crooked. The guides 20*a* and 21*a* may be driven in rotation by a drive source or may be free to follow the rotation of the endless belt 22. The guides 20*a* and 21*a* may be disposed at locations other than the drive roller 20 and tension roller 21.

The operation of the image forming apparatus 1 will be described with reference to FIG. 1. Arrows in dotted lines indicate the direction of travel of the recording paper 25. The image forming sections are of the same configuration, and differ only in color. For simplicity, only the operation of the image forming section for black will be described, it being understood that the other image forming sections may operate in a similar fashion.

A high voltage is applied to the charging unit 52, which in turn charges the entire surface of the photoconductive drum 51 as the photoconductive drum 51 rotates in a direction shown by arrow B. When the charged surface passes the exposing unit 53, the exposing unit 53 illuminates the charged surface of the photoconductive drum 51 to form an electrostatic latent image on the photoconductive drum 51. Then, when the electrostatic latent image passes the developing unit 54, the electrostatic latent image is developed with the toner into a visible toner image.

The feed roller 33 feeds the recording paper 25 from the paper cassette 23 page by page into a transport path. The recording paper 25 is then advanced by a registry roller 31 to a transfer point defined between the transfer roller 26 and the photoconductive drum 51 of the image forming section 11. A power supply (not shown) applies a high voltage to the transfer roller 26. As the recording paper 25 passes through the transfer point, the transfer roller 26 transfers a black toner image from the photoconductive drum 51 onto the recording paper 25. As the recording paper 25 passes through the respective image forming sections in sequence, toner images of corresponding colors are transferred onto the recording paper 25, so that a full color toner image is formed on the recording paper 25.

Subsequently, the recording paper 25 is transported by the endless belt 22 to the fixing unit 30 where the full color toner image is fused into the recording paper 25 under pressure and heat. The recording paper 25 is then discharged by the discharge roller 32 onto the stacker 34. After the recording paper 25 has left the endless belt 22, the cleaning blade 24 scrapes the residual toner and foreign substance adhering to the endless belt 22.

The endless belt 22 will be described in more detail.

The endless belt 22 is formed of polyamideimide (PAI). An appropriate amount of carbon black is added to the material for developing electrical conductivity. The material is then mixed in a solvent of N-methyl pyrrolidone (NMP) by agitation, thereby forming a molded endless belt by rotomolding. The endless belt 22 has a diameter of 198 mm. An endless belt having various shininess and ten-point height of roughness Rz may be obtained by appropriately adjusting the finish of the inner surface of the mold. The value of ten-point height of roughness and the value of shininess may be increased or decreased by polishing or plating the surface of the finishing tool.

The material for the endless belt is not limited to PAI but may be any material as long as the material is deformed only within a predetermined range when tensile force is applied to endless belt during rotation of the endless belt 22. Alternative materials include resins including polyimide (PI), polycarbonate (PC), polyamide (PA), polyether ether ketone (PEEK), polyvinylidene fluoride, and ethylene-tetrofluoride ethylene copolymer (ETFE), and mixtures that contain these materials as a major composition.

The solvent used for manufacturing the endless belt is selected appropriately. Polar organic solvents, especially, N, N-dimethylacetamides are commonly used. Other polar organic solvents include primarily N,N-dimethylformamide, N,N-dimethylacetamide, N,N-dimethylformamide, N,N-dimethylacetamide, dimethyl sulfoxide, NMP, pyridine, tetramethylenesulfone, and dimethyltetramethylenesulfone. These materials can be used alone or in combination.

Carbon black includes furnace black, channel black, and acetylene black. These materials can be used along or in combination. These materials may be selected appropriately according to desired electrical conductivity. Channel black and furnace black are particularly suitable for the endless belt of the invention. Channel black and furnace black may be subjected to a process such as oxidation treatment or graft treatment for preventing oxidation, or may be improved its ability to disperse in the solvent. The amount of carbon black in the endless belt is determined by the desired electrical conductivity and the type of carbon black. From a point of view of, for example, mechanical strength, the amount of carbon black contained in the endless belt of the invention is in the range of 3-40% by weight and more preferably in the range of 3-30% by weight.

Twelve types of endless belts (Examples #1-#12) having different values of ten-point height roughness and shininess were tested one at a time by using the image forming apparatus 1. The cleaning performance of the twelve types of endless belts was evaluated in terms of the results of continuous printing.

Ten-point height of roughness Rz (μm) is an average distance between the five highest peaks and the five lowest valleys based on a roughness profile of a material. Ten-point height of roughness Rz (μm) is measured according to Japanese Industrial Standard (JIS) B0601.

Conventional methods of measuring fine roughness of a surface include roughness and glossiness. However, the roughness and glossiness are merely measurements of a part of the properties of an object, and therefore image clarity is commonly evaluated by inspection. Shininess is a value calculated based on the clarity and brightness of a pattern reflected by an object when a reference pattern is projected onto the object. The shininess of an ideal object (a reference surface) has a value of shininess of 1000. The shininess of an object is expressed as a value relative to that of the ideal object. Values of shininess closer to the shininess of 1000 of the reference surface show that an object has a good value of (high) shininess.

A method for measuring shininess will be described with reference to FIG. 2.

Figure 2:
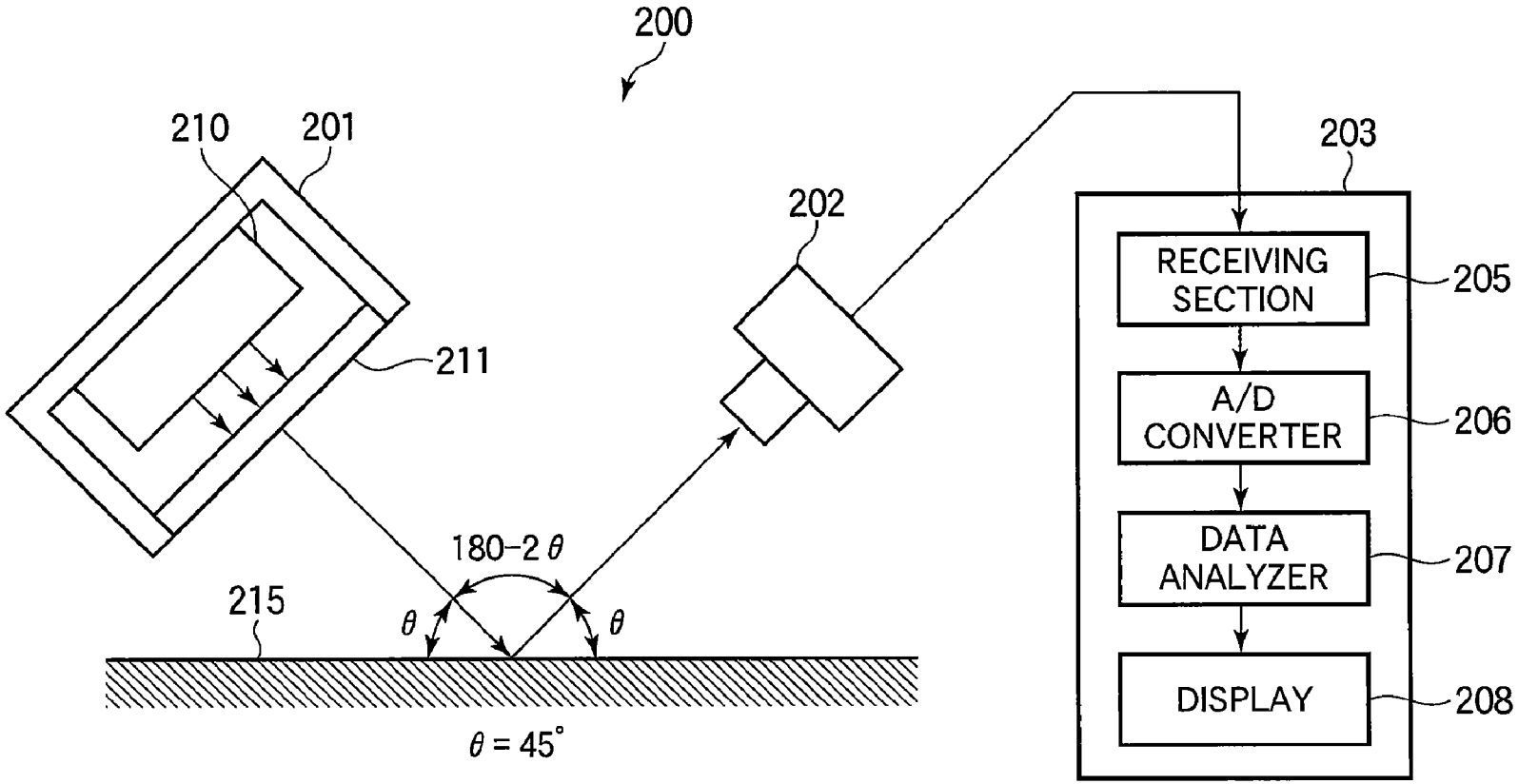
FIG. 2 illustrates a pertinent portion of a shininess measuring apparatus for measuring the shininess of an endless belt.

FIG. 2 illustrates a pertinent portion of a shininess measuring apparatus 200 for measuring the shininess of an endless belt. The shininess measuring apparatus 200 includes a pattern projecting device 201, a photoelectric transducer 202, and a signal processing device 203.

The pattern projecting device 201 includes a light source 210 and a pattern projecting plate 211.

Figure 3:
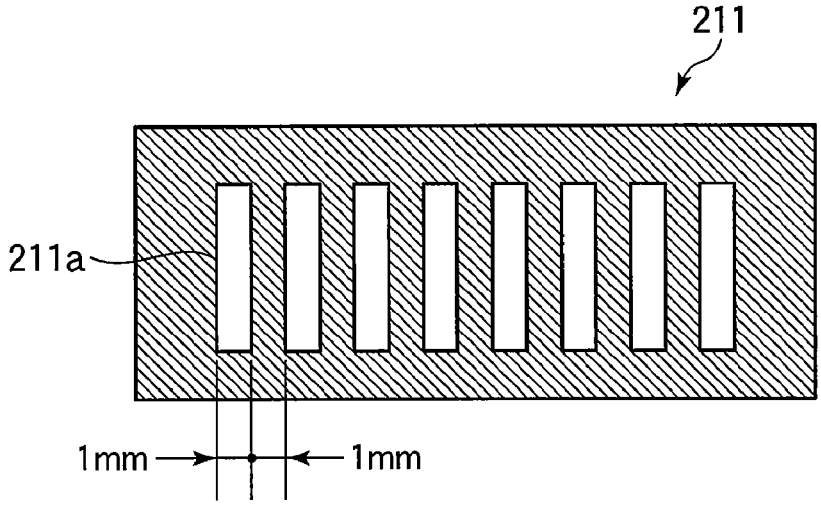
FIG. 3 illustrates the configuration of a pattern projecting plate.

FIG. 3 illustrates the configuration of the pattern projecting plate 211. Referring to FIG. 3, the pattern projecting plate 211 is a 0.5 mm-thick plate of stainless steel in which a line of a plurality of openings 211*a* having a width of 1 mm is formed. A lusterless paint is applied to the surface of the pattern projecting plate 211 to make the surface of the pattern projecting plate 211 non-reflective. The pattern projecting device 201 is positioned such that the light from the pattern projecting plate 211 is incident on the surface of an object 215 at an angle θ. The angle θ may be selected at will depending on the type of an object and the method of measuring shininess. In the embodiment, the angle θ is selected to be 45°.

The photoelectric transducer 202 is positioned such that the optical axis of the photoelectric transducer 202 lies in a plane in which the optical axis of the light projected from the pattern projecting plate 211 lies, and such that the optical axis of the photoelectric transducer 202 forms an angle of 180-2θ with the optical axis of the light projected from the pattern projecting plate 211. The photoelectric transducer 202 includes CCD arrays aligned in line or in a two-dimensional area, and captures a pattern projected onto the surface of the object 215. The captured pattern is converted into an electrical signal. The output of the photoelectric transducer 202 is sent to the signal processing device 203.

The signal processing device 203 includes a receiving section 205 that receives the electrical signal from the photoelectric transducer 202, an A/D converter 206 that converts the electrical signal into a digital signal, a data analyzer 207, and a display 208. The data analyzer 207 processes the digital signal received from the A/D converter 206 to extract local maxima (Max) and local minima (Min), and calculates the shininess of the object.

The operation of the shininess measuring apparatus 200 will be described.

Figure 4:
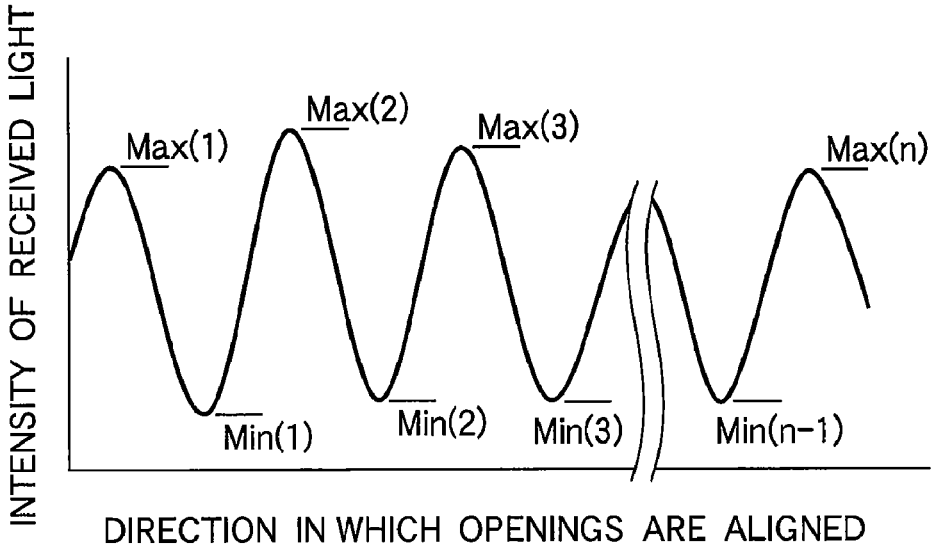
FIG. 4 is a graph illustrating data after A/D conversion.

The light source 210 emits parallel rays to the pattern projecting plate 211 to project a light-and-dark pattern of light onto the surface of the object 215. The photoelectric transducer 202 captures the projected pattern, converts the light intensity of the captured pattern into an electrical signal, and then sends the electrical signal to the signal processing device 203. The signal processing device 203 converts the received analog signal into a digital signal. FIG. 4 is a graph illustrating the data after A/D conversion.

The data analyzer 207 calculates an average Ave (Max) of local maxima Max(1), Max(2) . . . Max(n) and an average Ave (Min) of local minima Min(1), Main(2) . . . Min(n) from the following equations.

$$Ave(\text{Max}) = \left\{\sum_{n=1}^{n=n} \text{Max}(n)\right\} \Big/ n$$

$$Ave(\text{Min}) = \left\{\sum_{n=1}^{n=n} \text{Min}(n)\right\} \Big/ n$$

Based on the values of Ave (Max) and Ave (Min), the shininess may be calculated as follows:

$$\text{Shininess}=[\{\text{Ave(Max)}-\text{Ave(Min)}\}/\{\text{Ave(Max)}+\text{Ave(Min)}\}]\times 1000 \quad (1)$$

As described above, the closer to the shininess of 1000 of a reference surface, the better the surface of an object.

The toner used in the continuous printing contains styrene-acryl copolymer as a major component and 9 parts by weight paraffin wax capsulated by emulsion polymerization method, thereby obtaining toner particles having an average particle diameter of 7 μm and a sphericity of 0.95. This type of toner provides good sharpness and quality of image, improves transfer efficiency of toner images and producibility of dots, and eliminates the need for a toner release agent in the fixing unit. Roundness of toner particles is determined as follows: Roundness=(the circumference of a circle having the same area as a projected area of a particle)/the circumference of a projected image of the particle. The sphericity of toner particles is a sum of all calculated roundness of particles divided by the number of the particles (e.g., 3000 in the present embodiment). The sphericity in the embodiment is a measure indicative of the degree of surface roughness of toner particles. The sphericity is 1.00 for a perfectly spherical toner particle. The sphericity decreases with increasing complexity of the toner shape.

A cleaning blade is pressed against the belt to remove the residual toner by mechanical force. Cleaning blades formed of a resilient material (e.g., urethane rubber) are inexpensive and simple in construction. Such cleaning blades are highly effective in removing residual toner and foreign matter from a belt. The cleaning blade of the embodiment was formed of urethane rubber having a hardness of JIS A 83° and a thickness of 1.5 mm, and was mounted such that a line pressure was 4.3 g/mm. Urethane rubber is one of the best materials for the cleaning blade because urethane is hard and highly resilient, and has resistance to wear, oil, and ozone.

Continuous printing was performed to evaluate the cleaning performance of the endless belt as follows: Paper for a plain paper copier (PPC) was used as recording paper. The continuous printing was performed in three environments: a low-temperature and low-humidity environment (L/L, 10° C., 20%), a normal-temperature and normal-humidity environment (N/N, 23° C., 50%), and a high-temperature and high-humidity environment (H/H, 28° C., 85%).

A print pattern was a solid image having 100% density, and was printed on A3 paper in portrait orientation with a margin of 10 mm at four sides. Printing was in duplex printing. For example, simplex printing was performed on one surface of 100 pages of the recording paper and then another simplex printing was performed on another surface of the recording paper. Print quality was evaluated by counting the number of white streaks appearing in the printed images. The streaks appear in the printed images due to the fact that the residual toner adheres to the back surface of the succeeding recording paper.

FIGS. 5, 6, and 7 illustrate the test results of Examples #1-#12.

Continuous printing was performed on 30,000 sheets of the recording paper using Examples #1-#12 of endless belt under the aforementioned conditions. FIG. 5, FIG. 6, and FIG. 7 list the test results at the ends of every 2500 sheets in the three different environments, respectively.

Symbol "○" indicates that no streak appeared.

Symbol "Δ" indicates that not more than two streaks appeared.

Symbol "×" indicates that more than two streaks appeared.

Symbol "–" indicates that printing could not be performed and therefore no evaluation was made.

The aforementioned results show that values of ten-point height of roughness Rz larger than 0.2 μm or values of shininess of less than 100 cause poor cleaning performance. Also, values of ten-point height of roughness Rz less than 0.05 μm or values of shininess larger than 140 cause the cleaning blade to become tacky enough to stick to the endless belt, resulting in poor cleaning performance. For Examples #10-#12, the endless belt failed to run properly after printing the first 50 pages, and therefore, the cleaning performance was not evaluated.

Small values of shininess are apt to cause poor cleaning performance for the following reasons. A cleaning blade cannot apply a uniform line pressure on the endless belt having a low value of shininess, and therefore toner particles are apt to escape through gaps between the cleaning blade and the endless belt. This is especially true for the toner having a high degree of sphericity.

The smaller the particle diameter of the toner is, the higher the image quality is. However, the smaller the particle diameter is, the larger the specific surface is, so that a unit amount of toner has better adhesion to the endless belt, causing poor cleaning performance. The smaller the particle diameter is, the poorer the fluidity is, so that a larger amount of fluidity adding agent is required. Further, toner having a small particle diameter tends to escape through gaps between the cleaning blade and the endless belt having a low value of shininess, thus remaining on the endless belt. Sometimes, when the toner particles escape through the gaps, the particles may exert shearing force on the endless belt, causing local chipping in the cleaning blade.

Low shininess causes micro slip between the endless belt and printed areas of the recording paper when printing is performed in the duplex printing. Micro slip tends to scrape wax and external additive of the toner particles off the printed surface of the recording paper, the wax and external additive adhering to the endless belt. The cleaning blade collects a large amount of the wax and external additive, which in turn escape through the gaps between the cleaning blade and the endless belt. On the contrary, smaller values of Rz or larger values of shininess improve the flatness of an endless belt, in which case the cleaning blade is apt to become tacky enough to stick to the endless belt, exerting a large load on the endless belt with the result that the endless belt fails to run normally.

The above test results show that an endless belt having a value of Rz of not more than 0.2 μm and a value of shininess of not less than 100 prevents poor cleaning in all three environments of 10° C. and 20% RH (L/L) , 23° C. and 50% RH (N/N) , and 28° C. and 85% (H/H). For this reason, the image forming apparatus 1 of the embodiment employs an endless belt having a value of Rz not more than 0.2 μm and a value of shininess not less than 100.

The values of Rz in the rage of 0.05 to 0.2 μm and values of shininess in the range of 100 to 140 prevent the cleaning performance from becoming poor, thereby providing stable high quality images and the changes in temperature and humidity over time.

Second Embodiment

A second embodiment differs from the first embodiment in that an endless belt having a creep of not more than 0.03% is used. More preferably the creep is in the range of 0.01 to 0.02%.

The endless belt of the second embodiment is formed of PAI. An amount of carbon black is added to PAI for adding electrical conductivity, and is mixed and agitated in an NMP solvent. The thus prepared material is put into a rotomold in an atmosphere of an inert gas (e.g., helium), and is shaped into an endless belt having a thickness of 100 μm and a diameter of 198 mm. Endless belts having different values of creep may be obtained by selecting proportions of the inert gas and air mixed with the inert gas.

Figures 8, 9:
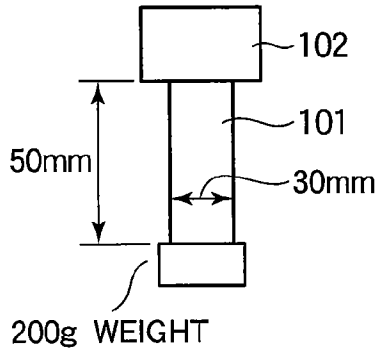
FIG. 8 illustrates a test piece 101 of an endless belt for evaluating creep.
FIG. 9 illustrates print results when continuous printing was performed.

FIG. 8 illustrates a test piece 101 of an endless belt for evaluating creep. The creep of endless belt is measured as follows:

An endless belt under test is cut into a test piece 101 having a width of 30 mm, and the test piece is suspended with its upper end fixed to a holder 102 and its lower end attached to a weight of 200 grams. The distance between the fixed portion and the weight is 50 mm. The distance increases as the time passes. A total change after 72 hours is expressed as a percentage of the original distance. This change expressed in percent is a value of creep. The smaller the creep is, the better the creep is, i.e., the endless belt is free from deformation.

Higher proportions of the inert gas to air provide an endless belt having a good creep characteristic. Lower proportions of the inert gas to air cause a poor creep characteristic.

Eight endless belts (Examples #21-#28) having different values of creep were manufactured and tested using the image forming apparatus 1. FIG. 9 lists print results when continuous printing was performed. Measurements of ten-point height roughness Rz and shininess were carried out using the same methods as in the first embodiment. Test conditions including cleaning means and toner were the same as those in the first embodiment. Examples #21-#28 have ten-point roughness Rz in the range of 0.05 to 0.2 μm and shininess in the range of 100 to 140. A material for an endless belt having a value of creep less than 0.01% is difficult to manufacture. Thus, materials having a value of creep larger than or equal to 0.01% were used.

Test results were evaluated by inspection in terms of warp of belt edges and color shift. Printing was performed in duplex printing on a total of 60,000 sheets: 20,000 sheets in a normal-temperature and normal-humidity environment, then 20,000 sheets in a high-temperature and high-humidity environment, and finally 20,000 sheets in a low-temperature and low-humidity environment. FIG. 9 lists the test results at the end of printing of 20,000 sheets, 40,000 sheets, and 60,000 sheets. After printing the total of 60,000 sheets, printing was again performed in the normal-temperature and normal-humidity.

Symbol "○" indicates that no change in the appearance of the endless belt was noticed and no color shift occurred.

Symbol "Δ" indicates that warp was observed in the edge portion of the endless belt and color shift occurred.

Symbol "×" indicates that crack was observed in the endless belt.

As described above, the creep of the endless belt not more than 0.03% is low enough to minimize the change in appearance of the endless belt and occurrence of color shift.

A smaller value of creep is more preferable for the following reasons. A large value of creep causes the endless belt to retain the impression of a supporting member that supports the endless belt. For example, the endless belt may be deformed in accordance with the shape of the drive roller 20 and/or the tension roller 21, so that the endless belt will have a hump in it. The circumferential speed of the endless belt will change in the hump. The partial change in circumferential speed of the endless belt causes color shift. The hump may contact the structures surrounding the endless belt to cause damage to the images or trouble of the apparatus. An endless belt having a small value of creep may be deformed even when it impressed against a guide that prevents crooked running of the endless belt.

A small value of creep implies that an endless belt is apt to plastically deform and the composition of the endless belt may change slightly. An endless belt is usually molded at a temperature in the range of 150-250° C. When an endless belt is molded, the temperature profile in the vicinity of an inner surface of a mold is different from that in the vicinity of atmosphere, so that oxidation caused by contacting with air and deterioration of the material may be different depending on areas of the endless belt and cause a small but significant difference in composition. Thus, the mold shrinkage factor varies for portions in contact with air and portions in contact with the mold, resulting in warp of the endless belt. Warp of the endless belt increases fatigue due to repetitive bending when the endless belt runs, producing cracks in the endless belt relatively early.

As described above, a value of creep of less than 0.03% prevents color shift and changes in the appearance of the endless belt that would otherwise occur when continuous printing is performed.

As described above, an endless belt having a value of creep of 0.03% continues to function properly for a long time under varying environmental conditions such as changes in temperature and humidity, providing high quality images.

Third Embodiment

Figure 10:
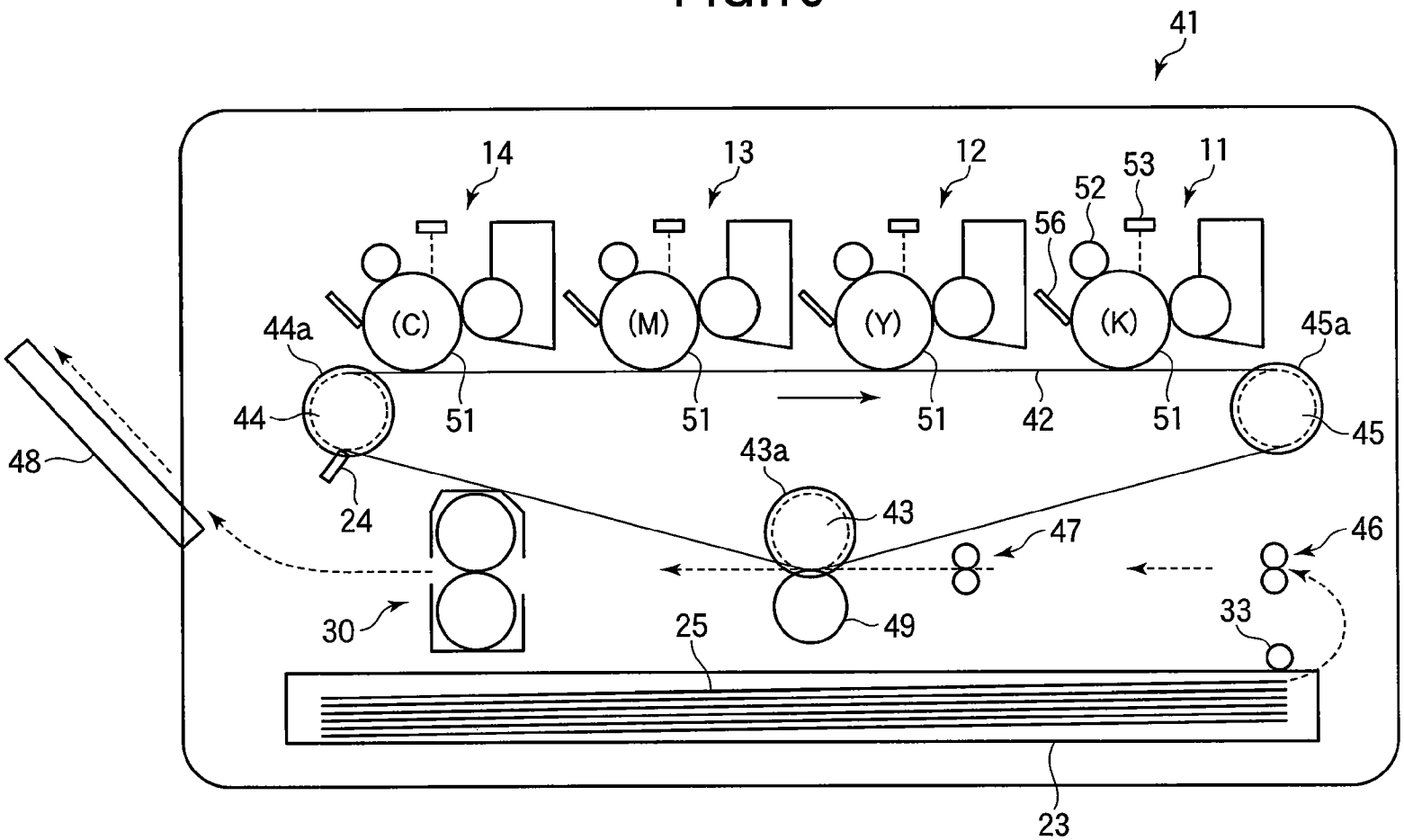
FIG. 10 illustrates a pertinent portion of an image forming apparatus of a third embodiment.

FIG. 10 illustrates a pertinent portion of an image forming apparatus 41 of a third embodiment.

Elements similar to those in the first embodiment have been given the same reference numerals and their description is omitted.

Referring to FIG. 10, the image forming apparatus 41 is a tandem type electrophotographic printer of an intermediate transfer system. A paper cassette 23 holds a stack of recording paper 25. A feed roller 33 feeds the recording medium 25 page by page from the paper cassette 23 into a transport path. Transport rollers 46 are disposed in the transport path and transport the pages of the recording paper 25 through image forming sections to a fixing unit 30. The image forming sections 14 to 11 are aligned from upstream to downstream along the transport path, and form cyan (C), magenta (M), yellow (Y), and black (k) images, respectively. Just as in the first embodiment, the image forming sections operate in a similar fashion and differ only in color.

The image forming apparatus 41 includes a belt unit in it. The belt unit includes an endless belt 42 as an intermediate transfer member (toner image bearing body) supporting rollers 43-45 that are driven by a drive source (not shown) and drives the endless belt 42 in rotation, and a cleaning blade 24 that scrapes the residual toner off the endless belt 42. The endless belt 42 is sandwiched between a supporting roller 43 and a transfer roller 49.

The supporting rollers 43-45 preferably include guides **43*a*-45*a* that engage the side edge or side edges of the endless belt 42 for preventing the endless belt 42 from running crooked. The guides 43*a*-45*a* may be driven in rotation by a drive source (not shown) or may be freely rotatable. Still alternatively, guides similar to the guides 43*a*-45*a* may be provided at locations other than the supporting rollers 43-45**.

The operation of the image forming apparatus 41 of the aforementioned configuration will be described. Arrows in dotted lines show a direction in which the recording paper 25 is transported.

The image forming sections 11-14 form electrostatic latent images of corresponding colors on the corresponding photoconductive drums 51, the electrostatic latent images are then developed with toners of the corresponding colors (i.e., cyan, magenta, yellow, and black). The toner images of the respective colors are transferred onto the endless belt 42 one over the toner in registration as the endless belt 42 passes through the image forming sections 11-14.

The feeding roller 33 feeds the recording paper 25 from the paper cassette 23 into the transport path, and the transporting rollers 46 and 47 transport the recording paper 25 to a transfer point defined between the transfer roller 49 and the endless belt 42. A high voltage is applied to the transfer roller 49 so that as the recording paper 25 passes through the transfer point, a full color toner image is transferred onto the recording paper 25.

Subsequently, the recording paper 25 with the full color toner image on it is advanced to the fixing unit 30. The toner image on the recording paper 25 is fixed under heat and pressure into a permanent full color image. After the recording paper 25 leaves the endless belt 42, the cleaning blade 24 scrapes the residual toner and foreign matter off the endless belt 42.

The endless belt 42 is manufactured in the same way as the endless belt 22 of the first embodiment, and has the same characteristics as the endless belt 22. In other words, the endless belt 42 has a value of ten-point height of roughness in the range of 0.05 to 0.2 μm and a value of shininess in the range of 100 to 140.

As described above, an endless belt in the third embodiment having the selected values of ten-point height of roughness Rz and shininess also provide stable high quality images in an intermediate transfer type image forming apparatus. For the same reasons as the first embodiment, the endless belt 42 continues to function properly with good cleaning performance for a long time under varying environmental conditions changes in temperature and humidity.

Just as in the second embodiment, the use of an endless belt having a value of creep of 0.03% minimizes changes in appearance including color shift. The endless belt continues to function with its intended performance for a long time under varying environmental conditions such as deterioration over time and changes in temperature and humidity.

While the present invention has been described with respect to an electrophotographic printer, the invention may also be applicable to, for example, a facsimile machine, a copying machine, and a multifunction printer. Although the embodiments have been described in terms of a printer that performs simplex printing, the invention may also be applied to a printer that performs duplex printing.

What is claimed is:

1. A belt unit comprising:

an endless belt having a value of ten-point height of roughness Rz in the range of 0.05 to 0.2 μm and a value of shininess in the range of 100 to 140; and a cleaning member that is in contact with said endless belt and removes a substance adhering to said endless belt, wherein the shininess is calculated based on an intensity of dark and bright portions of a test pattern reflected from said endless belt, and wherein the shininess is calculated using an equation, $$S=((\mathrm{Ave(Max)}-\mathrm{Ave(Min)})/(\mathrm{Ave(Max)}+\mathrm{Ave(Min)}))\times 1000$$

where S is shininess, Ave(Max) is an average of local maxima of the bright portions and Ave(Min) is an average of local minima of the dark portions.

2. The belt unit according to claim 1, wherein said endless belt has a creep not larger than 0.03%.

3. The belt unit according to claim 1, wherein said endless belt has a creep not smaller than 0.01%.

4. An image forming apparatus incorporating said belt unit according to claim 1, comprising:

an image forming section that forms a developer image; and a transfer unit that transfers the developer image onto a recording medium held on the endless belt.

5. A direct transfer type image forming apparatus incorporating said belt unit according to claim 1, comprising:

an image forming section that forms a developer image on a photoconductive drum; and a transfer unit that transfers the developer image from the photoconductive drum onto a recording medium carried on the endless belt.

6. An intermediate transfer type image forming apparatus incorporating said belt unit according to claim 1, comprising:

an image forming section that forms a developer image on the endless belt of said belt unit; and a transfer unit that transfers the developer image from the endless belt onto a recording medium.

7. The belt unit according to claim 1, wherein said endless belt contains carbon black in an amount in the range of 3 to 40% by weight.

8. The belt unit according to claim 1, wherein said endless belt contains carbon black in an amount in the range of 3 to 30% by weight.

9. The belt unit according to claim 1, wherein said cleaning member is a cleaning blade.

10. The belt unit according to claim 9, wherein the cleaning blade is formed of a resilient material.

11. The belt unit according to claim 10, wherein the resilient material is urethane rubber.

* * * * *